US011002159B1

(12) United States Patent
Simon

(10) Patent No.: US 11,002,159 B1
(45) Date of Patent: May 11, 2021

(54) TIMING WHEEL ATTACHMENT FOR CAMSHAFT PHASER

(71) Applicant: Schaeffler Technologies AG & Co. KG, Herzogenaurach (DE)

(72) Inventor: Timothy Simon, Wooster, OH (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/811,460

(22) Filed: Mar. 6, 2020

(51) Int. Cl.
*F01L 1/34* (2006.01)
*F01L 1/344* (2006.01)
*F01L 1/348* (2006.01)

(52) U.S. Cl.
CPC ..... *F01L 1/3442* (2013.01); *F01L 1/348* (2013.01); *F01L 2001/34426* (2013.01); *F01L 2001/34483* (2013.01); *F01L 2820/041* (2013.01)

(58) Field of Classification Search
CPC ... F01L 1/3442; F01L 1/348; F01L 2820/041; F01L 2001/34426; F01L 2001/34483
See application file for complete search history.

(56) References Cited

U.S. PATENT DOCUMENTS 3,699,637 A 10/1972 Rosiek
2006/0278188 A1* 12/2006 Payne ..... F01L 1/344 123/90.17
2007/0277758 A1* 12/2007 Fischer ..... F01L 1/3442 123/90.17

OTHER PUBLICATIONS

Li J et al., Variable speed gear box flange structure, has connecting flange whose top part is uniformly formed with multiple mounting holes, and target wheel fixedly connected with main body sleeve and formed as spline structure ; Derwent 2013-W18861; Abstract & Figure (Year: 2013).*

* cited by examiner

*Primary Examiner* — Zelalem Eshete
(74) *Attorney, Agent, or Firm* — Matthew V. Evans

(57) ABSTRACT

A camshaft phaser is provided that includes a stator, a rotor having a plurality of vanes that form fluid chambers with the stator, and a timing wheel attached to the rotor via a spline joint arranged between the rotor and timing wheel. The spline joint is configured to prevent axial and radial movement of the timing wheel relative to the rotor.

20 Claims, 6 Drawing Sheets

TIMING WHEEL ATTACHMENT FOR CAMSHAFT PHASER

TECHNICAL FIELD

Example aspects described herein relate to camshaft phasers, and, more particularly, to camshaft phasers utilized within an internal combustion (IC) engine.

BACKGROUND

Camshaft phasers are utilized within IC engines to adjust timing of an engine valve event to modify performance, efficiency and emissions. Hydraulically actuated camshaft phasers can be configured with a rotor and stator arrangement. The rotor can be attached to a camshaft and actuated hydraulically in clockwise or counterclockwise directions relative to the stator to achieve variable engine valve timing. A timing wheel is often employed within the camshaft phaser to facilitate tracking of a rotational position of the camshaft. A robust and cost effective means of attaching the timing wheel to the rotor is needed.

SUMMARY

In an example embodiment, a camshaft phaser includes a stator, a rotor having a plurality of vanes that form fluid chambers with the stator, and a timing wheel. The rotor is configured to be non-rotatably connected to a camshaft of an internal combustion engine. The timing wheel is attached in a pre-defined orientation to the rotor by a spline joint arranged between the timing wheel and rotor, the spline joint configured to prevent axial and radial movement of the timing wheel relative to the rotor.

The timing wheel can have a protrusion that cooperates with a recess arranged on the rotor to define the pre-defined orientation of the timing wheel. The timing wheel can have a disk portion that includes a radial outer wall that defines sensing windows that are configured to cooperate with a camshaft position sensor to provide an angular position of the camshaft. The timing wheel can house at least a portion of a hydraulic control valve. The timing wheel can also house at least a portion of a bias spring, which may include a radially inner side or an axially outer side of the bias spring.

The rotor can be configured with a plurality of splines to engage the timing wheel. The plurality of splines can be arranged on a radial inner surface of the rotor and can include a lead-in chamfer. The plurality of splines can span 360 degrees of the radial inner surface of the rotor. The plurality of splines can engage a radial outer surface of a cylindrical portion of the timing wheel. The radial outer surface can be tapered.

In an example embodiment, a rotor of a camshaft phaser is provided that includes a plurality of splines and a plurality of fluid passages configured to fluidly connect the fluid chambers with a fluid pressure source. The plurality of splines is configured to engage a timing wheel and prevent axial and radial movement of the timing wheel relative to the rotor. The plurality of splines can be formed on a radial inner surface of a counterbore of a through-bore of the rotor.

A method for installing a timing wheel to a rotor of a camshaft phaser is provided that includes:

1). Orienting the timing wheel to: i) a pre-determined rotational position relative to the rotor; and, ii) align a first rotational axis of the timing wheel to a second rotational axis of the rotor; the timing wheel having a first radial outer surface with a first outer diameter; and, 2). Applying an axial force to the timing wheel to attach it to the rotor, the axial force overcoming an interference fit between the first radial outer surface and a first radial inner surface of the rotor to move the timing wheel axially relative to the rotor; the first radial inner surface configured with a plurality of splines configured to engage the first radial outer surface, and the splines configured to prevent axial and radial movement of the timing wheel relative to the rotor.

The interference fit can cause the first radial outer surface to contract to a second outer diameter that is less than the first outer diameter. An optional protrusion arranged on the rotor is configured to cooperate with a recess arranged on the timing wheel to define the pre-determined rotation position of the timing wheel relative to the rotor.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
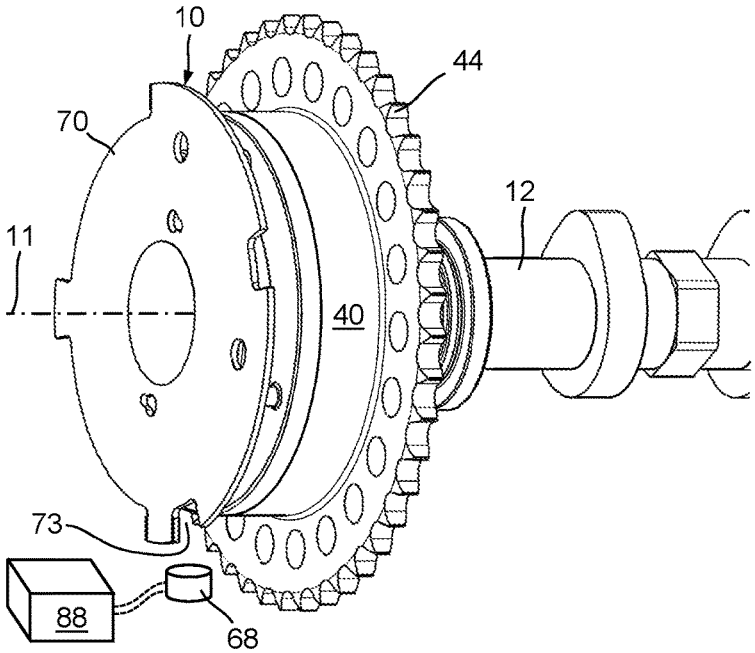
FIG. 1 is a perspective view of a camshaft together with an example embodiment of a camshaft phaser that includes a timing wheel.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

A term "non-rotatably connected" can be used to help describe various connections of camshaft phaser components and is meant to signify two elements that are directly or indirectly connected in a way that whenever one of the elements rotate, both of the elements rotate in unison, such that relative rotation between these elements is not possible. Radial and/or axial movement of non-rotatably connected elements with respect to each other is possible, but not required.

Figure 2:
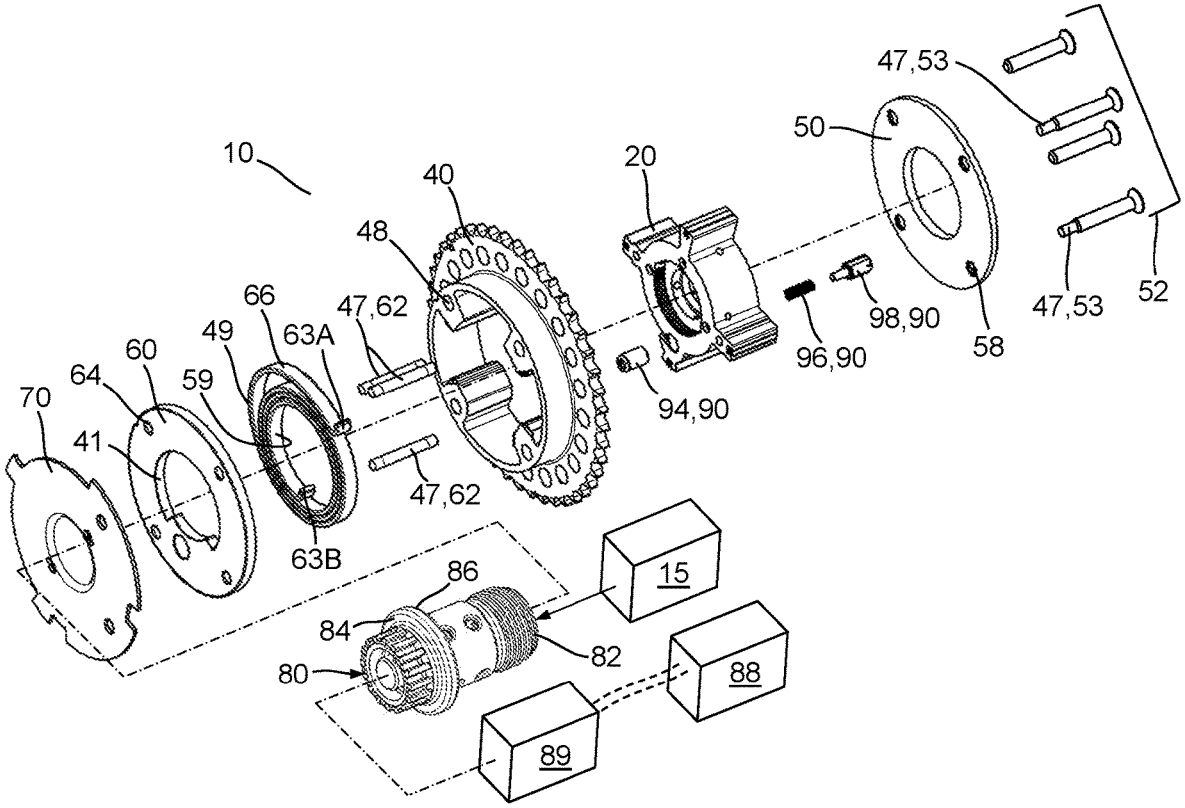
FIG. 2 is an exploded perspective view of the camshaft phaser of FIG. 1.
Figure 3:
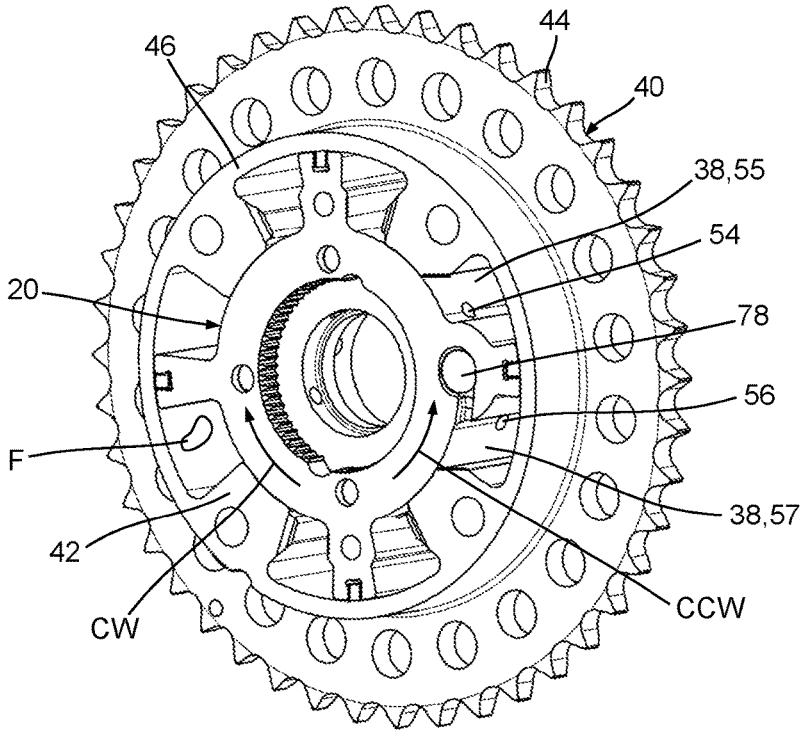
FIG. 3 is a perspective view of a rotor and stator of the camshaft phaser of FIG. 1.
Figure 4A:
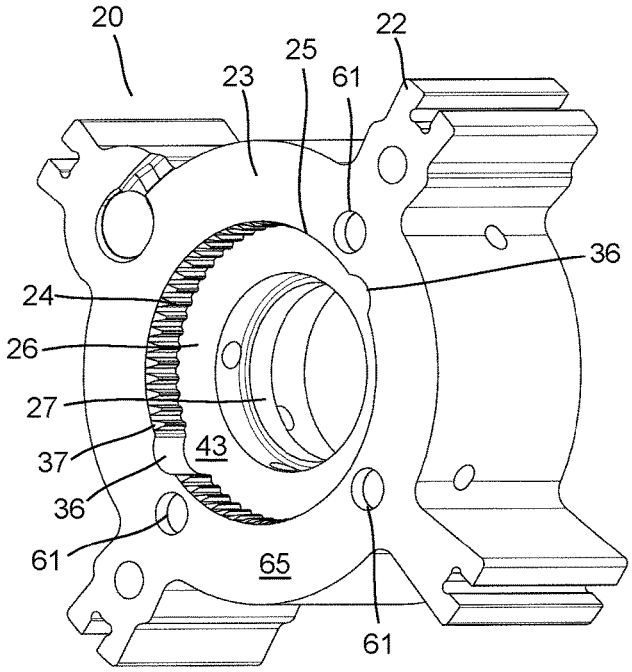
FIG. 4A is a perspective view of the rotor of the camshaft phaser of FIG. 1.
Figure 4B:
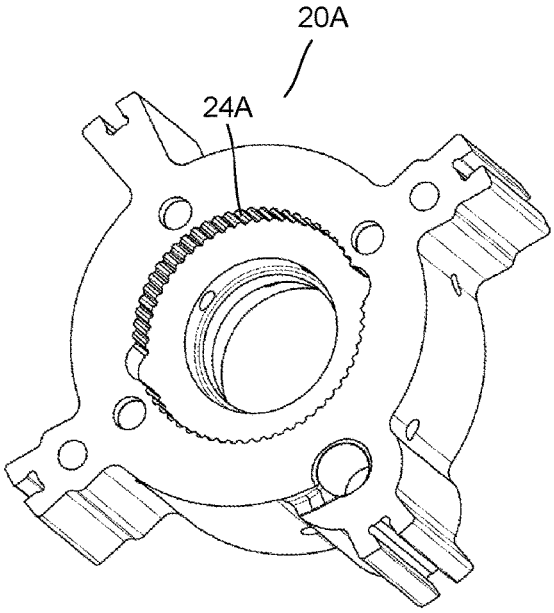
FIG. 4B is a perspective view of an example embodiment of a rotor.
Figure 5A:
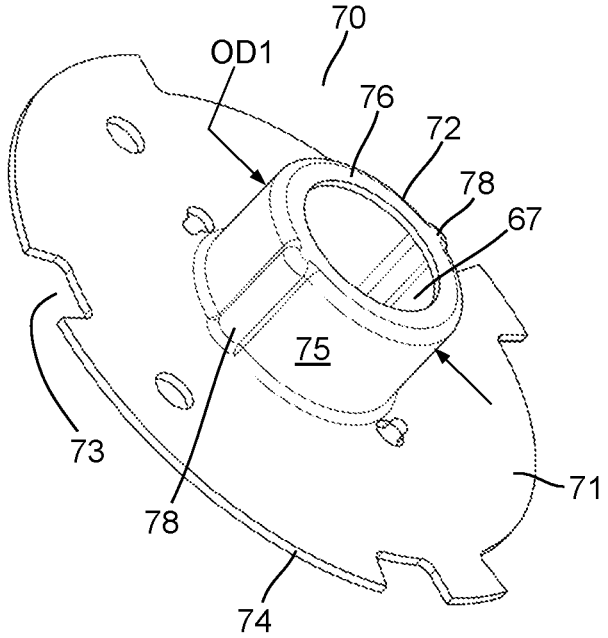
FIG. 5A is a perspective view of the timing wheel of the camshaft phaser of FIG. 1.
Figure 5B:
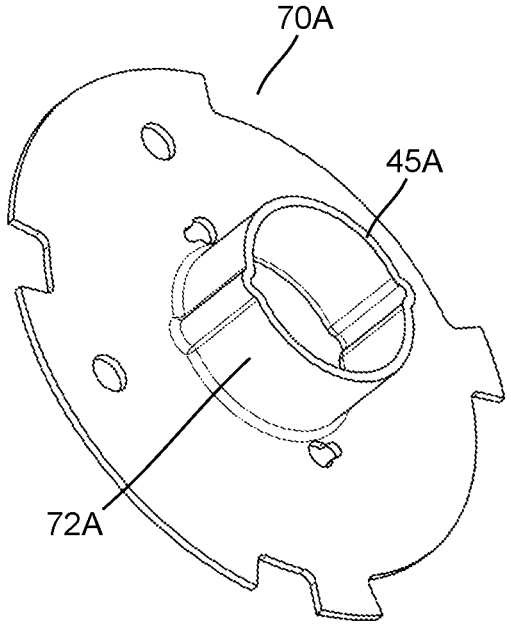
FIG. 5B is a perspective view of an example embodiment of a timing wheel.
Figure 6:
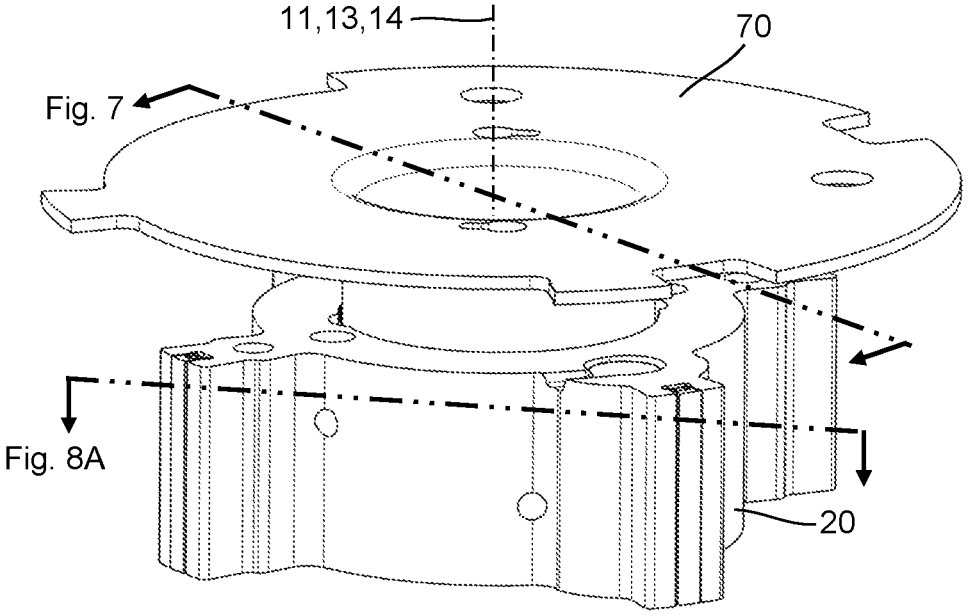
FIG. 6 is a perspective view of the timing wheel of FIG. 5A assembled together with the rotor of FIG. 4A.
Figure 7:
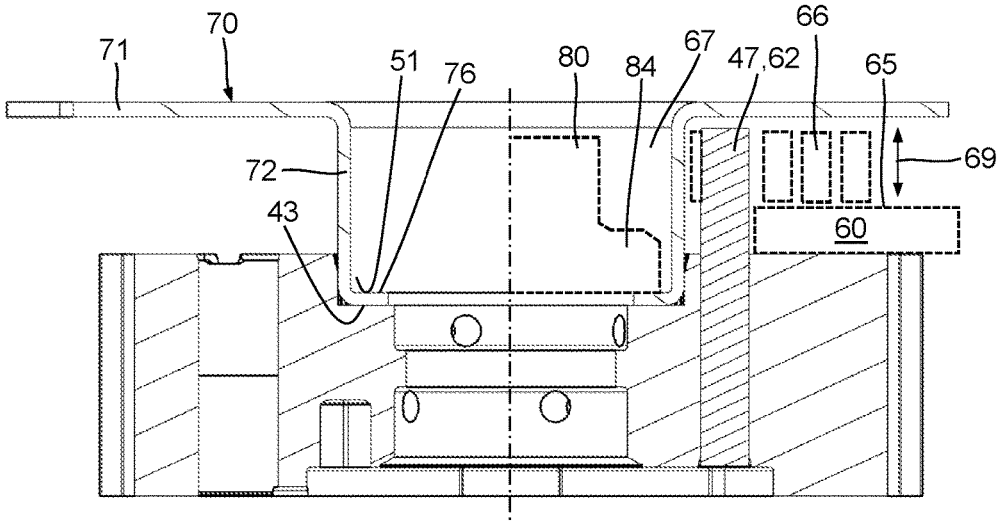
FIG. 7 is a cross-sectional view taken from FIG. 6.
Figure 8A:
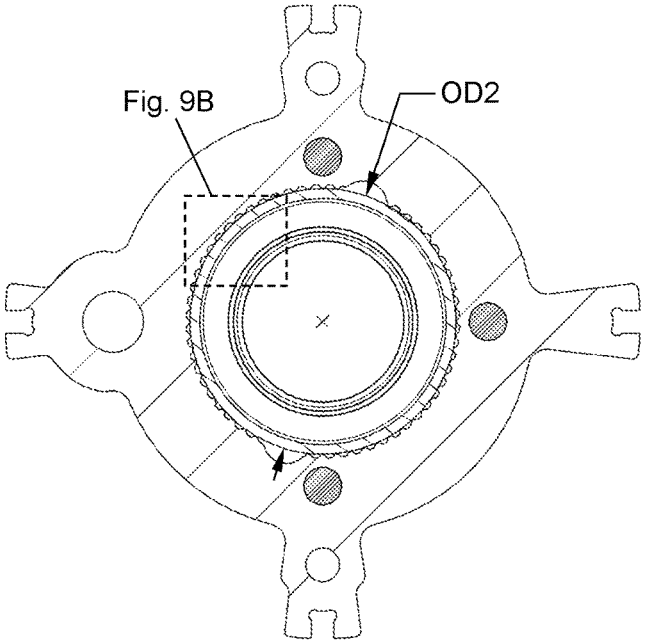
FIG. 8A is a cross-sectional view taken from FIG. 6.
Figure 8B:
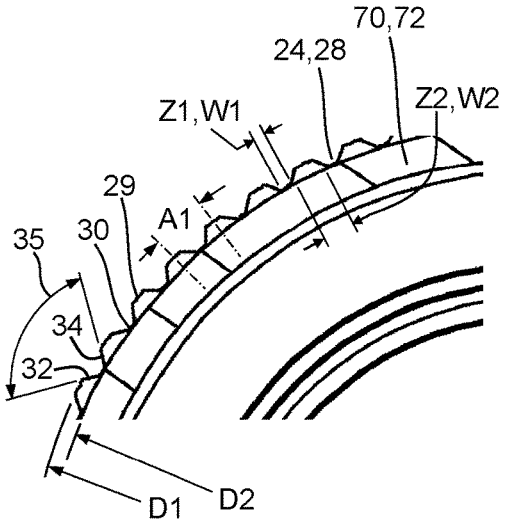
FIG. 8B is a detailed view taken from FIG. 8A.

FIG. 1 shows a perspective view of a camshaft 12 that is non-rotatably connected to a camshaft phaser 10 that includes a first example embodiment of a timing wheel 70. FIG. 2 shows an exploded perspective view of the camshaft phaser 10 of FIG. 1. FIG. 3 shows a perspective view of a rotor 20 assembled with a stator 40 for the camshaft phaser 10 of FIG. 1. FIG. 4A shows a perspective view of the rotor 20; and, FIG. 4B shows a perspective view of another example embodiment of a rotor 20A. FIG. 5A shows a perspective view of the first example embodiment of the timing wheel 70; and, FIG. 5B shows a perspective view of a second example embodiment of a timing wheel 70A. FIG. 6 provides a perspective view of the timing wheel 70 installed with the rotor 20. FIGS. 7 and 8A show cross-sectional views taken from FIG. 6. FIG. 8B is a detailed view taken from FIG. 8A. The following discussion should be read in light of FIGS. 1 through 8B.

The camshaft phaser 10 includes a rotational axis 11, a first cover 50, the rotor 20, a stator 40, a bias spring 66, a second cover 60, and the timing wheel 70. A locking assembly 90 can lock and unlock the rotor 20 from the second cover 60. The stator 40 of the camshaft phaser 10 is configured with an endless drive band interface 44, to rotationally connect the camshaft phaser 10 to a power source (not shown), potentially to that of a crankshaft of an internal combustion (IC) engine. An endless drive band such as a belt or chain (not shown) can be utilized to facilitate this connection, causing the camshaft phaser 10 to rotate around the rotational axis 11.

The rotor 20 includes vanes 22 that extend radially outward from a hub portion 23 of the rotor 20. The stator 40 includes protrusions 42 that extend radially inward from an outer ring portion 46 of the stator 40. A plurality of fasteners 52 extend through first apertures 58 of the first cover 50, through clearance apertures 48 of the stator 40, and attach to second apertures 64 of the second cover 60. The first cover 50 and second cover 60, together with the vanes 22 of the rotor 20 and protrusions 42 of the stator 40, form fluid chambers 38 within the camshaft phaser 10. The fluid chambers 38 could also be described as hydraulic actuation chambers. The camshaft phaser 10 is hydraulically actuated by pressurized hydraulic fluid F that is managed by a hydraulic fluid control valve 80 to move the rotor 20 either clockwise CW or counterclockwise CCW relative to the stator 40 via the fluid chambers 38. As the rotor 20 is connected to the camshaft 12, clockwise CW and counterclockwise CCW relative movements of the rotor 20 relative to the stator 40 can advance or retard an engine valve event with respect to a four-stroke cycle of an IC engine. With reference to FIG. 3, clockwise CW rotation of the rotor 20 relative to the stator 40 can be achieved by: 1). pressurization of a first chamber 55 via a first hydraulic fluid port 54; and, 2). de-pressurization of a second chamber 57 via a second hydraulic fluid port 56. Likewise, counterclockwise CCW rotation of the rotor 20 relative to the stator 40 can be achieved by: 1). pressurization of the second chamber 57 via the second hydraulic fluid port 56; and, 2). de-pressurization of the first chamber 55 via the first hydraulic fluid port 54. The preceding pressurization and de-pressurization actions of the first and second hydraulic fluid ports 54, 56 can be accomplished by the hydraulic fluid control valve 80. The hydraulic fluid control valve 80 is fluidly connected to a hydraulic fluid pressure source 15 and is actuated to different flow states by an electromagnet 89 which can communicate electronically with an electronic controller 88 to control the camshaft phaser 10.

The locking assembly 90 includes a locking pin 94, a force generator 96, and a retainer 98. The force generator 96 can be any component that provides a force on the locking pin 94 while permitting longitudinal movement of the locking pin 94. The force generator 96 can be a bias spring, elastomer, or any component that meets these described functional attributes. In an example embodiment, the locking assembly 90 can serve to selectively lock or unlock the rotor 20 from the stator 40, via the second cover 60.

One purpose of the timing wheel 70 is to provide angular position of the camshaft 12. This is accomplished by: A). non-rotatably connecting the timing wheel 70 to the rotor 20; and, B). non-rotatably connecting the rotor 20 to the camshaft 12. The timing wheel 70 includes a disk portion 71 and a cylindrical portion 72. Sensing windows 73 are formed on a radial outer wall 74 of the disk portion 71. The sensing windows 73 cooperate with a camshaft position sensor 68 to provide angular position of the camshaft 12. The sensor 68 can electronically communicate the angular position of the camshaft 12 to the electronic controller 88.

The timing wheel 70, or the cylindrical portion 72 thereof, extends through a bore 41 of the second cover 60 and is directly attached to the rotor 20 via a plurality of splines 24 that are arranged on a radial inner surface 25 of the rotor 20. The term "spline" or "plurality of splines" is meant to signify, respectively, a projection or series of projections that extend from the radial inner surface 25. The radial inner surface 25 is formed on a counterbore 26 of a through-bore 27 of the rotor 20; however, other suitable locations of the radial inner surface 25 could also be possible. An interference or press-fit is present between the plurality of splines 24 and the cylindrical portion 72 of the timing wheel 70, forming a spline joint. This spline joint or spline interface between the rotor 20 and timing wheel 70 provides both axial and radial retention of the timing wheel 70 to the rotor 20. The term "spline joint", for the sake of this disclosure, is defined by the presence of splines on a first component that are configured to form an interference fit with a surface of a second component to prevent relative axial and radial movement between the two components, once jointly fitted together. Comparing a non-spline joint to the described spline joint, a spline joint is likely to provide higher axial and radial retention while requiring less of a joining force to overcome interference fit of the joint.

The term "internal spline" can be used to describe the plurality of splines 24 formed on the radial inner surface 25 of the rotor 20. The splines 24 can be tooth-like in geometry, having multiple teeth 28 or projections that are spaced apart in succession at angular intervals A1. A profile of each of the teeth 28 can include a root 29 and a peak 30, as defined by a root diameter D1 that connects the successive roots, and a peak diameter D2 that connects the successive peaks, respectively, with the root diameter D1 larger than the peak diameter D2. The root 29 can be described as a radially outer-most portion of the teeth 28, and the peak 30 can be described as a radially inner-most portion of the teeth 28. Therefore, the plurality of splines 24 can be described as a series of teeth 28 or projections that have either: A). peak and root portions that alternate with each other around a periphery of the radial inner surface 25 of the rotor 20; or, B). large radius and small radius portions that alternate with each other around a periphery of the radial inner surface 25 of the rotor 20. Furthermore, each of the teeth 28 has a v-shaped profile 35 that is formed by a first angled side 32 and a second angled side 34. The narrowest part of the v-shaped profile forms the peak 30 which contacts the timing wheel 70 forming a contact zone Z1 with a first width W1. A non-contact zone Z2 resides between the teeth 28 and has a second width W2 that is greater than the first width W1. The contact zone Z1 of the peak 30 alternates with the non-contact zone Z2 throughout the span of the plurality of splines 24. Several other suitable spline teeth profiles and configurations, other than what is described and shown in the figures, are also possible.

In a free state, or un-installed state, the cylindrical portion 72 of the timing wheel 70 has a first outer diameter OD1. The first outer diameter OD1 is larger than the peak diameter D2 of the splines 24, yielding an interference fit between the cylindrical portion 72 and the splines 24 of the rotor 20. The interference fit resides between the peak 30 of each of the splines 24 and the radial outer surface 75 of the cylindrical portion 72 of the timing wheel, resulting in alternating or intermittent contact zones Z1 between the splines 24 and the radial outer surface 75. This contact can cause: A). deformation (elastic or plastic) of the radial outer surface 75; and/or, B). material removal from the radial outer surface 75, such that the splines 24, or the peaks 30 thereof, dig into the radial outer surface 75. A magnitude of the deformation and/or material removal likely equates to a magnitude of retention provided by the spline joint or spline interface. The interference fit will likely cause the cylindrical portion 72 to reduce in diameter in an installed state, yielding a second outer diameter OD2 that is less than the first outer diameter OD1.

The cylindrical portion 72 of the timing wheel 70 is formed with two optional protrusions 78 that can be received by two optional recesses 36 configured within the counterbore 26 of the rotor 20. The timing wheel 70 is typically installed at a pre-determined rotational position relative to the rotor 20, and this arrangement can serve as an assembly aid to achieve the proper assembled position. The protrusions 78 and recesses 36 can be arranged in a poka-yoke pattern for further error-proofing to ensure the proper assembled position. However, only one of the two protrusions 78 and one of the two recesses 36 may be necessary to ensure proper orientation of the timing wheel 70 relative to the rotor 20. In an example embodiment without the described protrusions 78 and recesses 36, the plurality of splines spans 360 degrees of the radial inner surface 25 of the counterbore 26 of the rotor 20.

FIGS. 4A and 4B show two example embodiments of rotors 20, 20A arranged with respective splines 24, 24A. The splines 24 of FIG. 4A are formed with a lead-in chamfer 37, while the splines 24A of FIG. 4B do not have a chamfer. The lead-in chamfer 37, and geometry thereof, could influence a magnitude of force required to install the timing wheel 70 to the rotor 20.

Figure 9A:
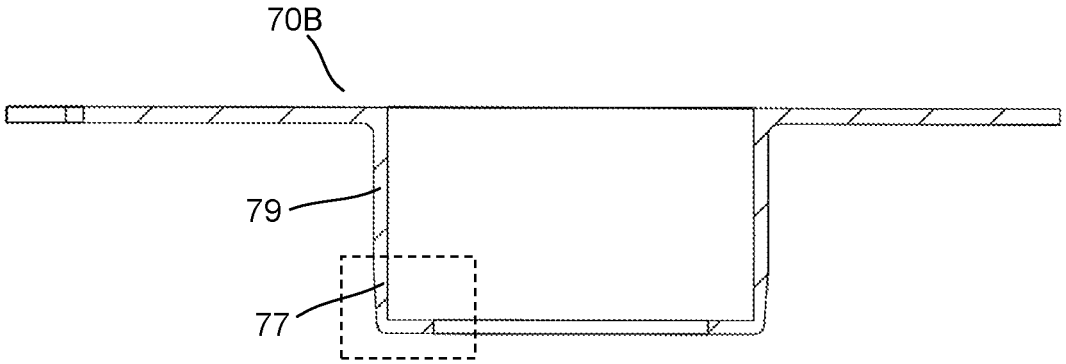
FIG. 9A is a cross-sectional view of an example embodiment of a timing wheel for a camshaft phaser, the timing wheel incorporating a tapered interface for interfacing with a rotor of a camshaft phaser.
Figure 9B:
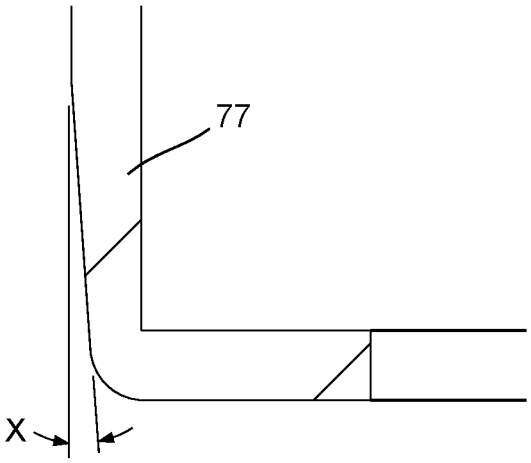
FIG. 9B is a detailed view taken from FIG. 9A.

FIGS. 9A and 9B show a cylindrical portion 72A of a third example embodiment of a timing wheel 70B with a tapered end 77 configured at an angle X relative to a non-tapered region 79 of the cylindrical portion 72A. The tapered end 77, and its geometry thereof, could influence a magnitude of force required to install the timing wheel 70B to either of the previously described rotors 20, 20A.

In the first example embodiment of the timing wheel 70 shown in FIG. 5A, the cylindrical portion 72 of the timing wheel 70 includes a radial rim 76 that abuts or engages with a seating surface 43 of the counterbore 26 of the rotor 20. The radial rim 76 is configured with a seating surface 51 for the hydraulic fluid control valve 80. The hydraulic fluid control valve 80 is attached to the camshaft 12 via threads 82. When the hydraulic fluid control valve 80 is tightened to the camshaft 12, a flange surface 86 of a flange 84 of the hydraulic fluid control valve 80 engages the seating surface 51.

For clarity purposes, FIG. 6 shows the assembly of the timing wheel 70 to the rotor 20 without the presence of the hydraulic fluid control valve 80, the second cover 60, and the bias spring 66; a portion of these three components are drawn with broken lines in the cross-sectional view of FIG. 7 so that their relative positions to the timing wheel 70 and rotor 20 are evident without detracting from the clarity of the view. Referring to FIG. 7, an inner hollow 67 of the cylindrical portion 72 of the timing wheel 70 houses or surrounds a portion of the hydraulic fluid control valve 80 in its installed position. In addition, the timing wheel 70 houses the bias spring 66, providing an axial space 69 between the disk portion 71 and a face 65 of the second cover 60. The axial space 69 also houses at least one elongated anchor 47 for either guiding the bias spring 66 or attaching a first end 63A and a second end 63B of the bias spring 66 to the stator 40 and rotor 20, respectively. The elongated anchors 47 for the bias spring 66 can be fulfilled by: A). dowels 62 that are attached to the rotor 20 via bores 61; and/or, B). end extensions 53 of the fasteners 52 that protrude out of the second cover 60. The cylindrical portion 72 and the disk portion 71 of the timing wheel 70 houses or surrounds at least a portion of the bias spring 66 on a radially inner side 59 and an axially outer side 49, respectively.

In the second example embodiment of the timing wheel 70A shown in FIG. 5B, the cylindrical portion 72A is void of a radial rim, therefore, the flange 84 and corresponding flange surface 86 of the hydraulic fluid control valve 80 directly engages the rotor 20. An axial end surface 45A of the cylindrical portion 72A can abut directly against the seating surface 43 of the counterbore 26 of the rotor 20 in an installed position of the timing wheel 70A.

Figure 10:
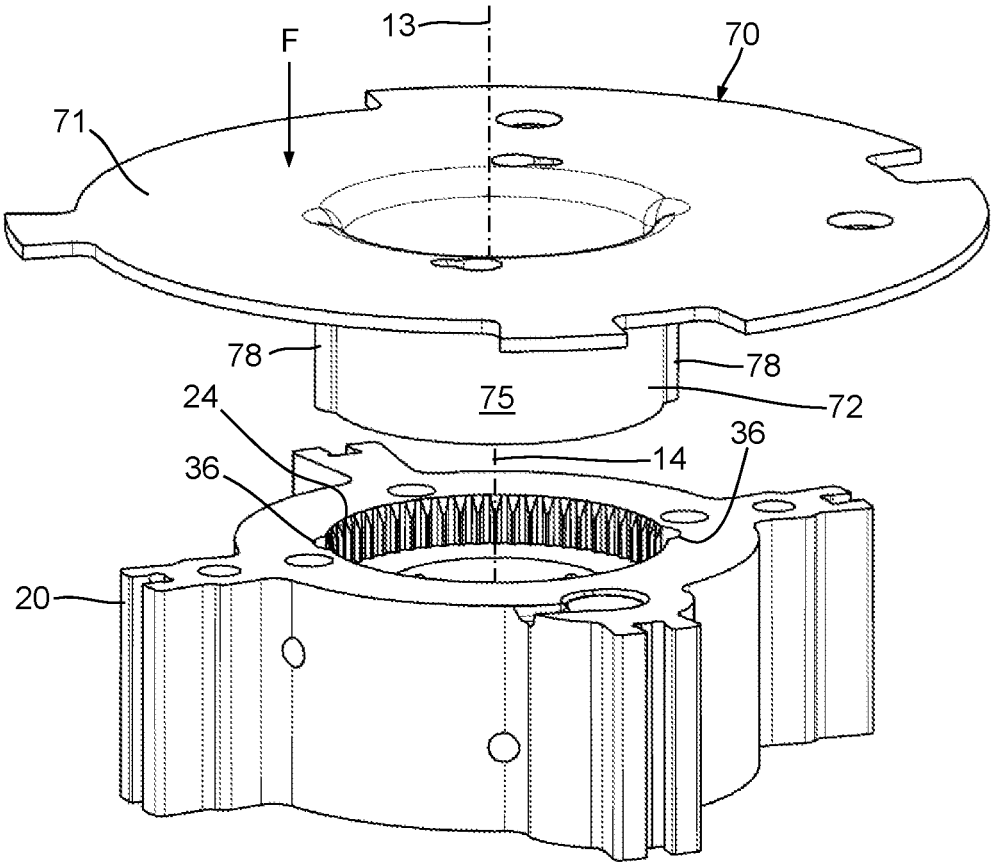
FIG. 10 is a perspective view of the timing wheel of FIG. 5A together with the rotor of FIG. 4A.
Figure 11:
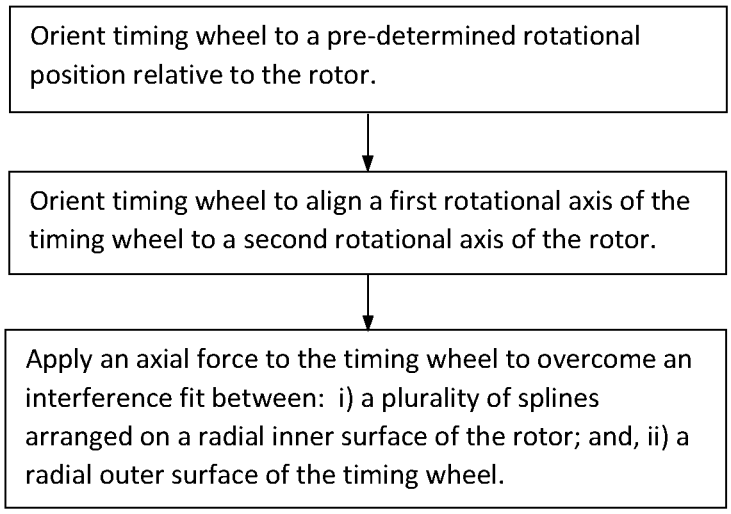
FIG. 11 is a block diagram for a method of installing the timing wheel to the rotor, both of FIG. 10, the timing wheel both axially and radially retained by the rotor.

For the previously described timing wheel 70 and rotor 20, the following installation steps can be carried out, as shown in FIGS. 10 and 11:

Orient the timing wheel 70 to a pre-determined rotational position relative to the rotor 20;

Orient the timing wheel 70 to align a first rotational axis 13 of the timing wheel 70 to a second rotational axis 14 of the rotor 20;

Apply an axial force F to the timing wheel 70 to overcome an interference fit between the plurality of splines 24 arranged on the radial inner surface 25 of the rotor 20 and the radial outer surface 75 of the timing wheel 70, to seat the cylindrical portion 72 against the seating surface 43 of the rotor 20.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A camshaft phaser comprising:

a rotational axis;

a stator;

a rotor having a plurality of vanes that form fluid chambers with the stator, the rotor configured to be non-rotatably connected to a camshaft of an internal combustion engine; and a timing wheel attached in a pre-defined orientation to the rotor by a spline joint arranged between the timing wheel and rotor, the spline joint configured to prevent axial, radial, and rotational movement of the timing wheel relative to the rotor.

2. The camshaft phaser of claim 1, wherein a protrusion arranged on the timing wheel cooperates with a recess arranged on the rotor to define the pre-defined orientation of the timing wheel.

3. The camshaft phaser of claim 1, wherein the timing wheel further comprises a disk portion that includes a radial outer wall, the radial outer wall defining sensing windows that are configured to cooperate with a camshaft position sensor to provide an angular position of the camshaft.

4. The camshaft phaser of claim 1, wherein the timing wheel is configured to house at least a portion of a hydraulic control valve.

5. The camshaft phaser of claim 1, wherein the timing wheel is configured to house at least a portion of a bias spring.

6. The camshaft phaser of claim 1, wherein the spline joint comprises one of either the timing wheel or the rotor having a plurality of splines, and a remaining one of the timing wheel or rotor having a non-splined surface.

7. The camshaft phaser of claim 1, wherein the rotor is configured with a plurality of splines to engage the timing wheel.

8. The camshaft phaser of claim 6, wherein one of the plurality of splines and the non-splined surface define a contact zone, the contact zone having a circumferential width and an axial length, and the axial length is greater than the circumferential width.

9. The camshaft phaser of claim 7, wherein the plurality of splines is arranged on a radial inner surface of the rotor.

10. The camshaft phaser of claim 1, wherein the timing wheel is attached to the rotor via only the spline joint.

11. The camshaft phaser of claim 9, wherein the plurality of splines engages a radial outer surface of the timing wheel.

12. The camshaft phaser of claim 11, wherein the radial outer surface is tapered.

13. The camshaft phaser of claim 11, wherein the timing wheel further comprises a cylindrical portion that includes the radial outer surface.

14. A rotor for a camshaft phaser, the rotor comprising:

a plurality of vanes configured to form fluid chambers with a stator;

a plurality of fluid passages configured to fluidly connect the fluid chambers with a fluid pressure source;

a plurality of splines configured to: i) engage a timing wheel; and, ii) prevent axial, radial, and rotational movement of the timing wheel relative to the rotor.

15. The rotor of claim 14, wherein the plurality of splines are formed on a radial inner surface of the rotor.

16. The rotor of claim 15, further comprising a through-bore, the radial inner surface formed within a counterbore of the through-bore.

17. The rotor of claim 14, wherein the timing wheel further comprises a cylindrical portion that includes a radial outer surface configured to engage the splines.

18. A method for installing a timing wheel to a rotor of a camshaft phaser, comprising:

orienting the timing wheel to: i) a pre-determined rotational position relative to the rotor; and, ii) align a first rotational axis of the timing wheel to a second rotational axis of the rotor; the timing wheel having a first radial outer surface with a first outer diameter; and applying an axial force to the timing wheel to attach it to the rotor, the axial force overcoming an interference fit between the first radial outer surface and a first radial inner surface of the rotor to move the timing wheel axially relative to the rotor, the first radial inner surface configured with a plurality of splines configured to engage the first radial outer surface, and the splines configured to prevent axial, radial, and rotational movement of the timing wheel relative to the rotor.

19. The method of claim 18, wherein the interference fit causes the first radial outer surface to contract to a second outer diameter that is less than the first outer diameter.

20. The method of claim 18, wherein a protrusion arranged on the rotor cooperates with a recess arranged on the timing wheel to define the pre-determined rotational position of the timing wheel relative to the rotor.

* * * * *